US011248374B2

(12) United States Patent
Brekke

(10) Patent No.: US 11,248,374 B2
(45) Date of Patent: Feb. 15, 2022

(54) FACADE SUPPORT SYSTEM

(71) Applicant: Columbia Insurance Company, Omaha, NE (US)

(72) Inventor: Steven Brekke, Lakeville, MN (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 0 days.

(21) Appl. No.: 16/911,845

(22) Filed: Jun. 25, 2020

(65) Prior Publication Data

US 2020/0407970 A1 Dec. 31, 2020

Related U.S. Application Data

(60) Provisional application No. 62/866,724, filed on Jun. 26, 2019.

(51) Int. Cl.
*E04B 1/16* (2006.01)
*E04B 1/41* (2006.01)

(52) U.S. Cl.
CPC ..... *E04B 1/4178* (2013.01)

(58) Field of Classification Search
None
See application file for complete search history.

(56) References Cited

U.S. PATENT DOCUMENTS 1,854,633 A 4/1932 Stephens
4,452,545 A 6/1984 Colautti
4,955,172 A 9/1990 Pierson
5,265,396 A 11/1993 Amimoto
5,299,403 A * 4/1994 Fentz ..... E04B 1/7629 52/379
5,619,834 A * 4/1997 Chen ..... E04F 13/0855 52/126.1
5,675,942 A * 10/1997 Crawford ..... E04F 13/0892 52/127.3
5,816,008 A 10/1998 Hohmann
5,984,527 A 11/1999 Kober
6,098,364 A 8/2000 Liu
6,128,883 A 10/2000 Hatzinikolas
6,164,029 A * 12/2000 Lee ..... E04F 13/0851 52/235
6,212,841 B1 4/2001 Plume
7,017,318 B1 3/2006 Hohmann
7,171,788 B2 2/2007 Bronner
7,225,590 B1 * 6/2007 diGirolamo ..... E04B 1/4178 52/379

(Continued)

*Primary Examiner* — Basil S Katcheves
(74) *Attorney, Agent, or Firm* — Stinson LLP

(57) ABSTRACT

A veneer tie for use in a wall to join an inner wall member and an outer wall member of the wall. The outer wall member is formed from a plurality of successive courses of masonry units with a mortar-filled bed joint between each two adjacent courses. The veneer tie includes an insertion portion configured for disposition in the bed joint and an attachment portion. The attachment portion includes an adjustment element and a securing element. The securing element defines a first opening that receives a fastener to secure the attachment portion to the inner wall member. The adjustment element is secured to the insertion portion and is movable relative to the securing element in order to move the insertion portion relative to the outer wall member to position the insertion portion in the bed joint.

20 Claims, 10 Drawing Sheets

(56) References Cited

U.S. PATENT DOCUMENTS

| | | | | |
|---|---|---|---|---|
| 7,587,874 | B2 * | 9/2009 | Hohmann, Jr. | E04B 1/4178 52/565 |
| 7,908,804 | B2 | 3/2011 | Vieira | |
| 8,511,032 | B2 * | 8/2013 | Abdel-Rahman | E04B 2/88 52/655.1 |
| 8,621,802 | B2 * | 1/2014 | Spyrou | E04B 1/003 52/378 |
| 8,739,485 | B2 | 6/2014 | Holmann, Jr. | |
| 8,839,587 | B2 | 9/2014 | Hohmann, Jr. | |
| 9,010,064 | B1 * | 4/2015 | Farahmandpour | E04B 1/4185 52/714 |
| 9,038,350 | B2 | 5/2015 | Hohmann, Jr. | |
| 9,260,855 | B2 | 2/2016 | Farahmandpour | |
| 9,856,655 | B2 | 1/2018 | Knight | |
| 9,932,740 | B2 * | 4/2018 | Farahmandpour | E04B 1/4178 |
| 10,221,559 | B2 | 3/2019 | Hatzinikolas | |
| 10,323,419 | B2 | 6/2019 | Hatzinikolas | |
| 2004/0231270 | A1 | 11/2004 | Collins | |
| 2007/0011964 | A1 | 1/2007 | Smith | |
| 2012/0191138 | A1 | 7/2012 | Kiester | |
| 2013/0232893 | A1 | 9/2013 | Hohmann, Jr. | |
| 2013/0247498 | A1 | 9/2013 | Hohmann, Jr. | |
| 2014/0250814 | A1 * | 9/2014 | Hohmann, Jr. | E04B 1/4178 52/379 |
| 2019/0127971 | A1 | 5/2019 | Stauffer et al. | |
| 2020/0102734 | A1 * | 4/2020 | Hohmann, Jr. | E04B 1/4185 |

* cited by examiner

FACADE SUPPORT SYSTEM

CROSS-REFERENCE TO RELATED APPLICATION

This application claims priority to U.S. Provisional Patent Application No. 62/866,724, filed on Jun. 26, 2019, the entirety of which is hereby incorporated by reference.

FIELD

The present disclosure generally relates to a facade support system used in building construction, and more specifically, to a veneer tie used to connect an outer wall member to an inner wall member of a wall.

BACKGROUND

A facade can be a durable and aesthetically desirable construction for a building exterior. Facades, such as brick or stone veneer walls, also provide protection to the interior of the building from the surrounding environment. Anchoring systems, such as veneer ties, are used to secure facades (e.g., outer wythes) to inner wall members (e.g., inner wythes, stud frame walls, etc.) of a building to overcome forces which might pull the facade away from the building. These anchoring systems extend from the inner wall of the building to the facade. Generally, anchoring systems, such as veneer ties are connected to the inner wall with a fastener. When the facade is comprised of bricks, the anchoring systems are generally connected to the facade by positioning portions of the anchoring system in the mortar filled bed joint between adjacent courses of bricks.

SUMMARY

In one aspect, a veneer tie is used in a wall to join an inner wall member and an outer wall member of the wall. The outer wall member is formed from a plurality of successive courses of masonry units with a mortar-filled bed joint between each two adjacent courses. The veneer tie comprises an insertion portion configured for disposition in the bed joint. The veneer tie also comprises an including an adjustment element and a securing element. The securing element defines a first opening configured to receive a fastener to secure the attachment portion to the inner wall member. The adjustment element is secured to the insertion portion and is movable relative to the securing element in order to move the insertion portion relative to the outer wall member to position the insertion portion in the bed joint.

In another aspect, a method of positioning a veneer tie on a wall is disclosed. The wall has an inner wall member and an outer wall member. The outer wall member is formed from a plurality of successive courses of masonry units with a mortar-filled bed joint between each two adjacent courses. The method comprises securing an attachment portion of the veneer tie to the inner wall member. The includes an adjustment element and a securing element. The method also comprises moving the adjustment element relative to the securing element to position an insertion portion of the veneer tie in the bed joint.

Other objects and features of the present disclosure will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENT

Figure 1:
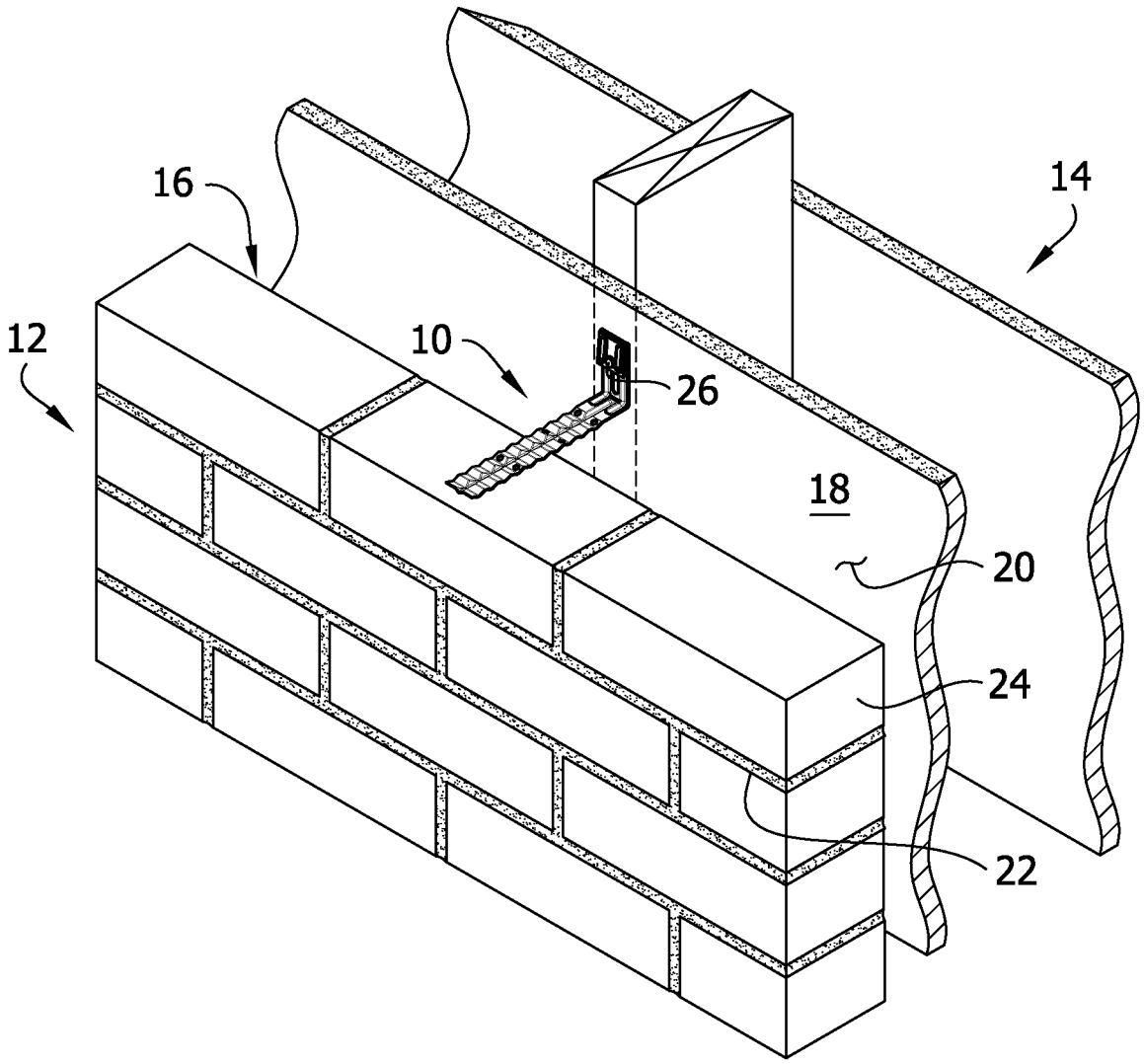
FIG. 1 is a perspective of a veneer tie according to one embodiment of the present disclosure connecting an outer wall member to a stud frame inner wall member.
Figure 2:
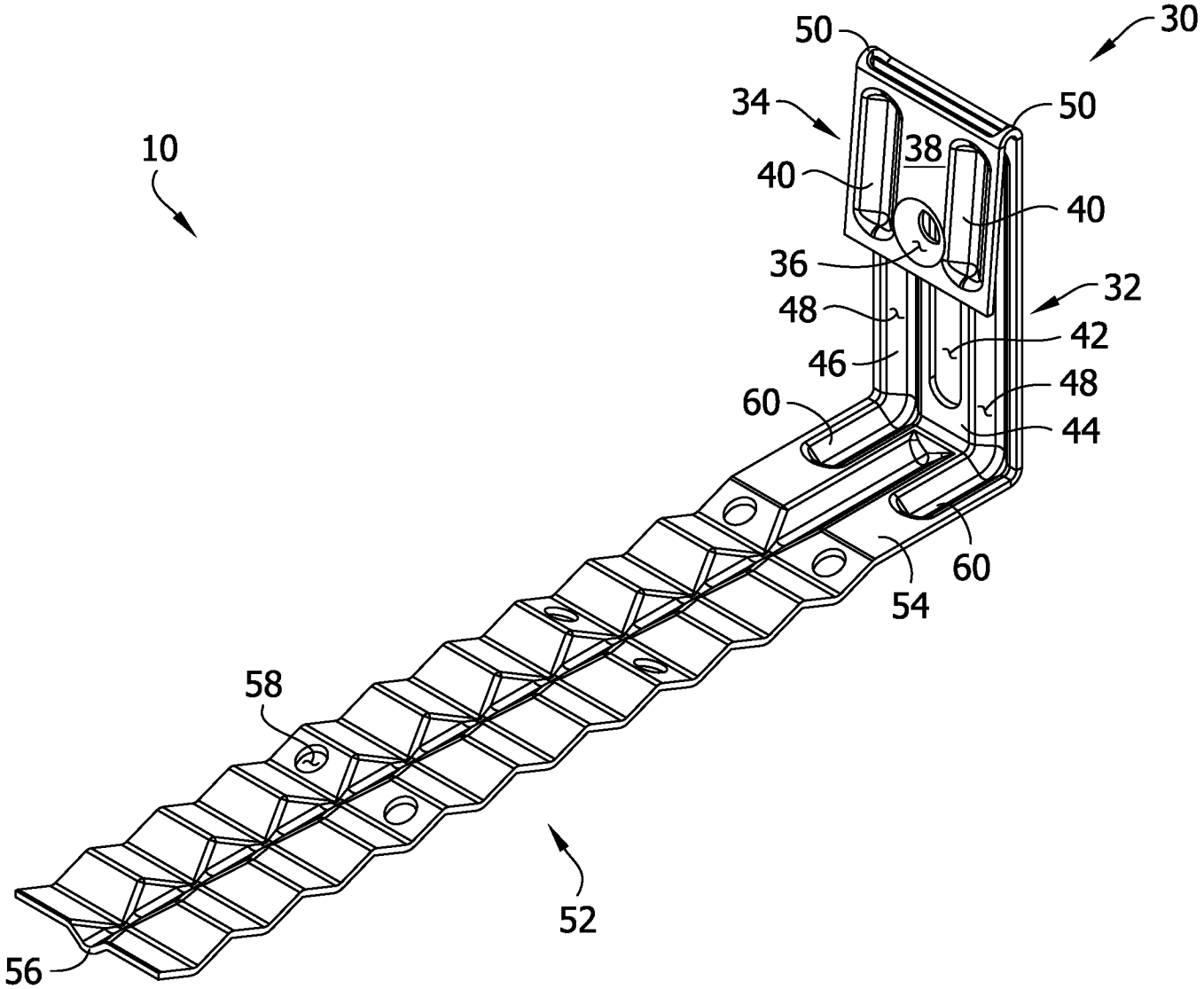
FIG. 2 is a perspective of the veneer tie.

Referring to FIG. 1, an embodiment of a veneer tie connecting an outer wall member 12 to an inner wall member 14 of a wall in a building is shown generally at 10. In this embodiment, a masonry wall structure is shown having the inner wall member 14 of stud frame construction including a stud and wall members (e.g., panels) on either side of the stud. The veneer or outer wall member 12 is shown as being of brick construction. The outer wall member 12 has an interior surface or side 16. The inner wall member 14 has an exterior surface or side 18. The exterior side 18 of the inner wall member 14 faces and is spaced from the interior surface 16 of the outer wall member 12. The inner wall member 14 may also be of another suitable construction, such as concrete, masonry, etc. (not shown). Between the inner wall member 14 and outer wall member 12, a cavity 20 is formed separating the inner wall member 14 and outer wall member 12. It is to be understood that the inner wall members and outer wall members may have other constructions and arrangements than described herein that are within the scope of the present disclosure.

Figure 8:
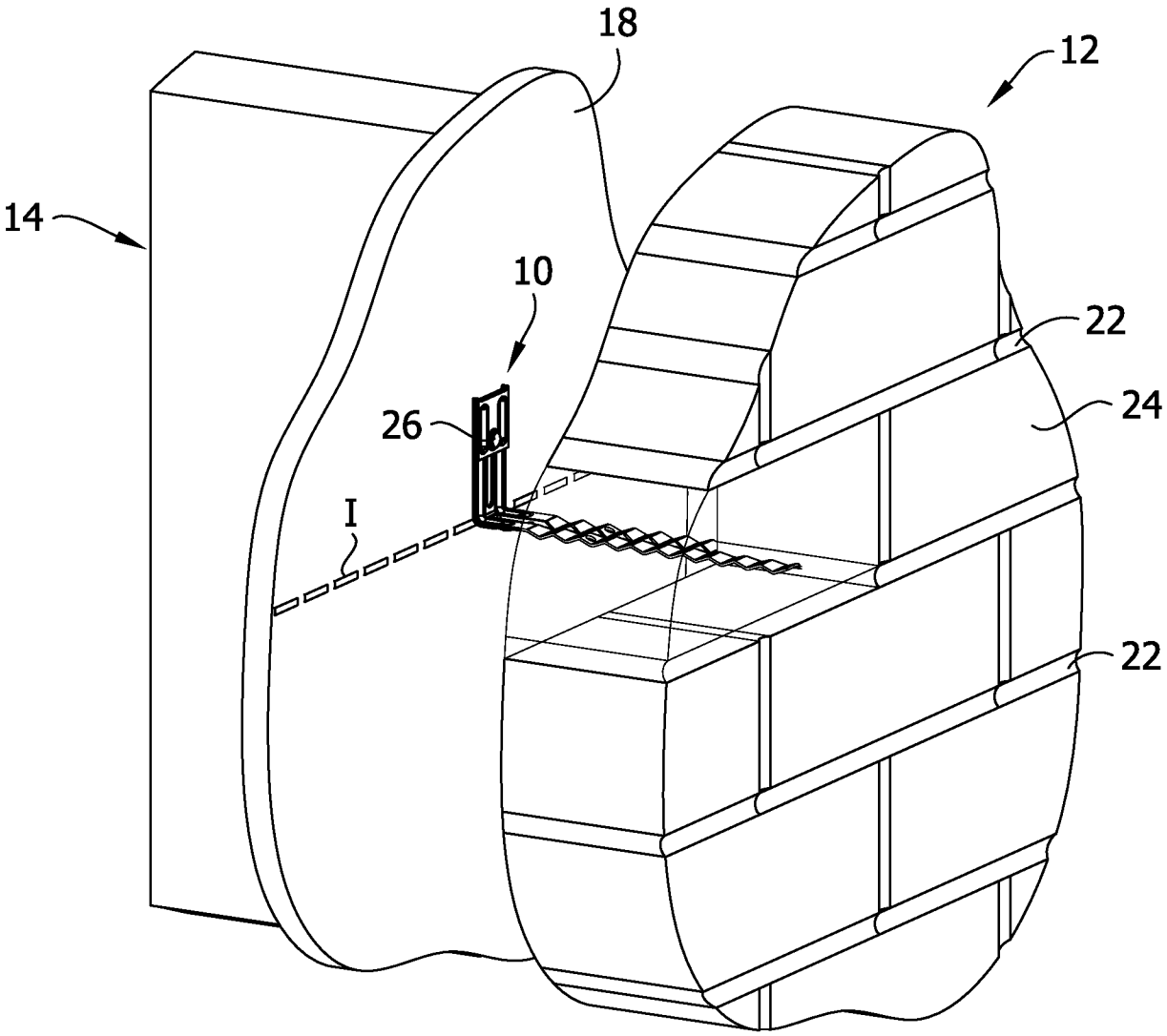
FIG. 8 is a perspective of the veneer tie connecting an outer wall member of a wall to an inner wall member, an insertion portion of the veneer tie disposed at a first position relative to the inner wall member.

The outer wall member 12 has successive bed joints 22 filled with mortar formed between adjacent courses of bricks 24 that are substantially planar and horizontally disposed. The bed joints 22 are specified as to the height or thickness of the mortar layer and the thickness specification is adhered to so as to provide the requisite uniformity for quality construction. In accordance with building standards, the bed joints 22 are approximately 0.375 inches (0.9525 cm) in height in a typical embodiment. However, bed joints 22 of different heights are within the scope of the present disclosure. Select bed joints 22 receive a veneer tie 10 which extends from the bed joint 22 across the cavity 20 and engages the exterior surface 18 of the inner wall member 14. The veneer tie 10 is secured to the exterior surface 18 of the inner wall member 14 with a fastener 26 (e.g., screw, nail, bolt, etc.) (FIG. 8). In this way the veneer tie 10 anchors the outer wall member 12 to the inner wall member 14.

As shown in FIGS. 2-5, the veneer tie 10 includes an attachment portion 30 and an insertion portion 52. The attachment portion 30 is configured to be attached to the exterior surface 18 of the inner wall member 14. The attachment portion 30 includes an adjustment element 32 and a securing element 34. As explained in more detail below, the adjustment element 32 is movable relative to the securing element 34 in order to move the insertion portion 52 relative to the outer wall member 12 to position the insertion portion in the bed joint 22. The securing element 34 is configured to secure the veneer tie 10 to the inner wall member 14. The securing element 34 defines (e.g., includes) an opening 36 configured to receive the fastener 26 (e.g., wall anchor) to secure the attachment portion 30 to the inner wall member 14. In the illustrated embodiment, the opening 36 is bent inwardly in a segment of a sphere to stiffen the area of the securing element 34 around the opening. This helps distribute the load of the fastener 26 over the securing element 34 as the fastener is attached to the inner wall member 14 and limits any deformation in the securing element caused by securing the fastener to the inner wall member. As will become apparent, significant deformation of the securing element 34 due to the fastener 26 may prevent the adjustment element 32 from being able to move relative to the securing element 34, when the veneer tie 10 is attached to the inner wall member 14. The securing element 34 overlaps a portion of the adjustment element 32. The securing element 34 includes a plate 38. The securing element 34 includes two ribs 40 (broadly, at least one rib). The ribs 40 extend along and project from the plate 38 (e.g., an inner surface thereof) toward the adjustment element 32. The two ribs 40 are disposed on opposite sides of the opening 36. The ribs 40 strengthen and stiffen the securing element 34.

The adjustment element 32 is connected to the securing element 34. As explained in more detail below, the adjustment element 32 is movable relative to securing element 34 when the securing element is attached to the inner wall member 14 with the fastener 26. The adjustment element 32 is configured to be disposed between the inner wall member 14 and the securing element 34 when the veneer tie 10 is mounted on the inner wall member. In particular, the adjustment element 32 is disposed rearward of the securing element 34. In this manner, the securing element 34 presses (e.g., compresses) the adjustment element against the exterior surface 18 of the inner wall member 14 when the fastener 26 secures the attachment portion 30 to the inner wall member. The adjustment element 32 defines an opening 42 configured to receive the fastener 26 when the fastener secures the attachment portion 30 to the inner wall member. A portion of the opening 42 in the adjustment element is aligned with the opening 36 in the securing element 34. Accordingly, the fastener 26 extends through both the adjustment element 32 and securing element 34 when the attachment portion 30 is mounted on the inner wall member 14 with the fastener. In the illustrated embodiment, the opening 42 defined by the adjustment element 32 is an elongate slot, although other shapes are within the scope of the present disclosure. The slot 42 is sized and shaped to permit the fastener to move within the slot (e.g., from one end of the slot to the other end). As explained in more detail below, the slot 42 allows for the adjustment of the veneer tie 10 relative to the outer wall member 12 after the veneer tie is secured to the inner wall member 14.

Figure 3:
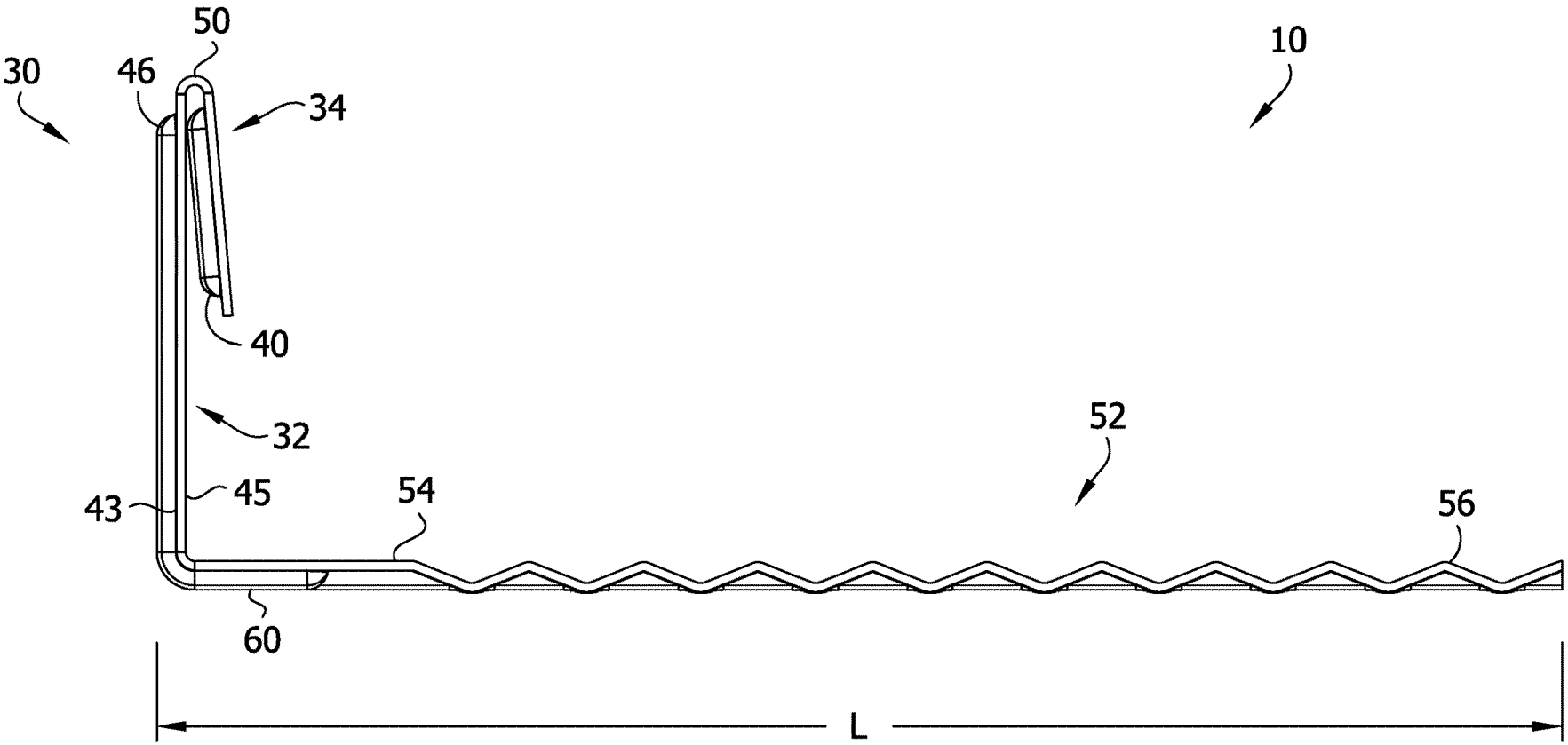
FIG. 3 is a side view thereof.
Figure 4:
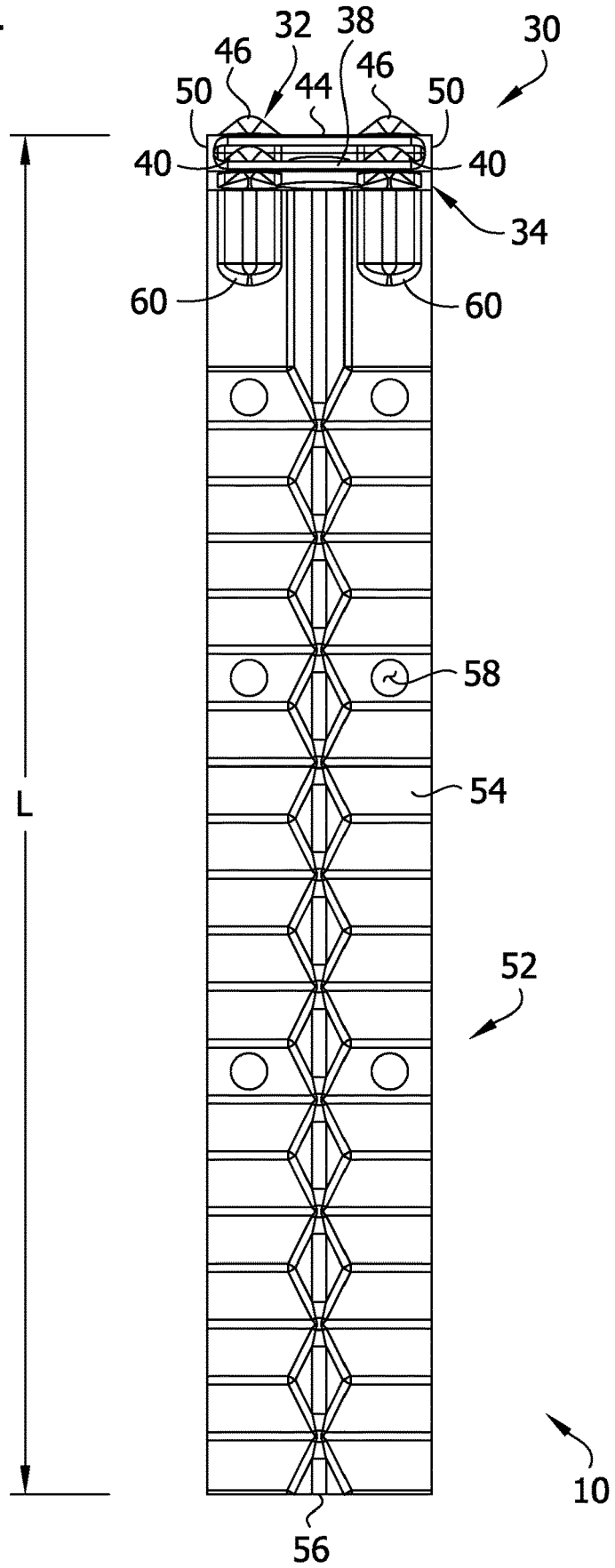
FIG. 4 is a top view thereof.
Figure 5:
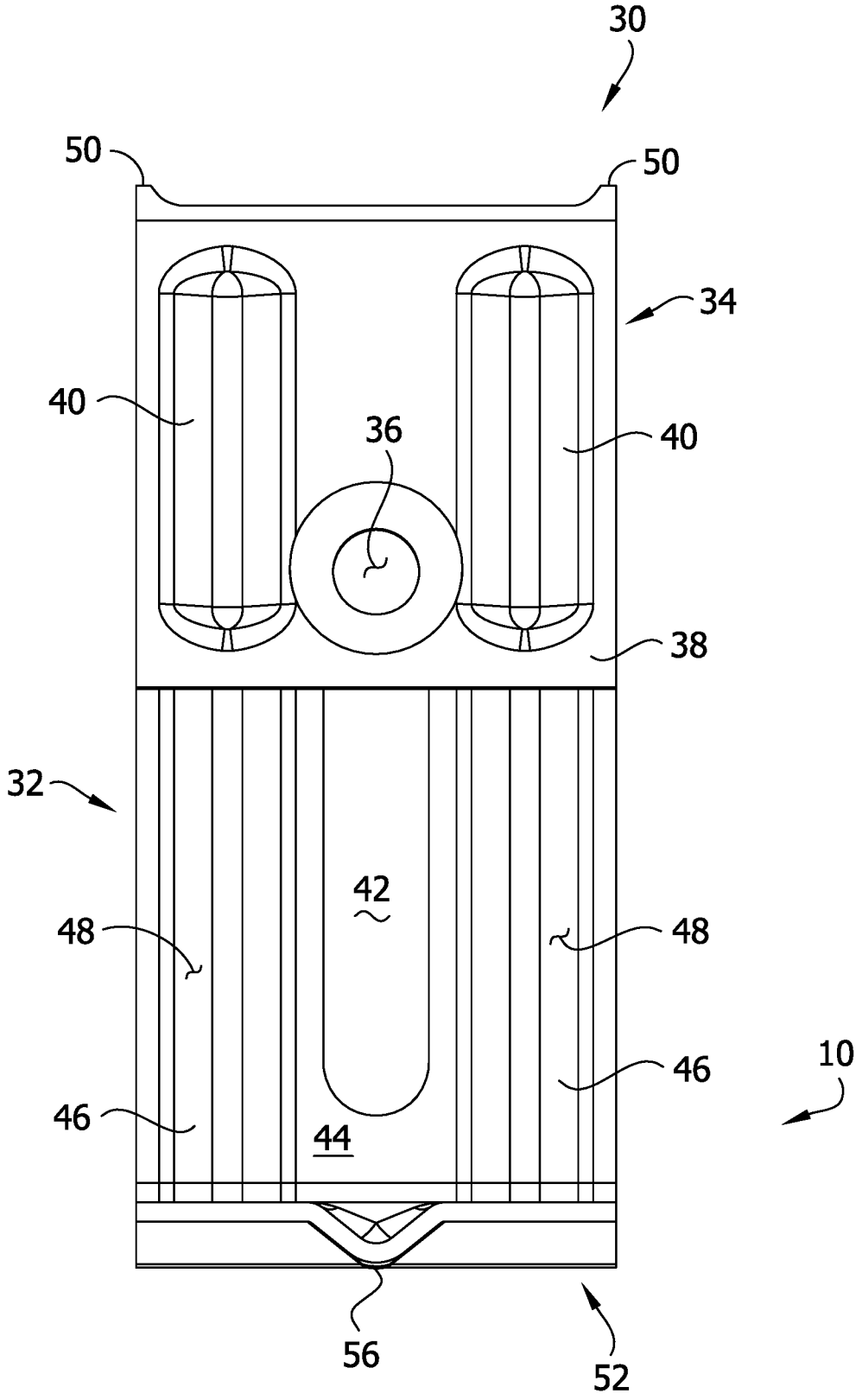
FIG. 5 is a front view thereof.

The adjustment element 32 includes a plate 44. The plate 44 has a rear or inner face 43 and an opposite front or outer face 45 (FIG. 3). The inner face 43 is adapted to face the exterior surface 18 of the inner wall member 14 when the veneer tie 10 is mounted to the inner wall member. The outer face 45 is adapted to face outward, away from the exterior surface 18 of the inner wall member 14 when the veneer tie 10 is mounted to the inner wall member. The adjustment element 32 includes two ribs 46 (broadly, at least one rib). The ribs 46 extend along the adjustment element 32 and are generally parallel to the slot 42. The ribs 46 project rearward from the plate 44. Specifically, the ribs 46 project rearward or inward from the inner face 43. When the veneer tie 10 is mounted on the inner wall member 14, the ribs 46 extend toward the inner wall member to engage the exterior surface 18 of the inner wall member. The two ribs 46 are disposed on opposite sides of the slot 42. The ribs 46 strengthen and stiffen the adjustment element 32. Each rib 46 defines a channel 48. Each channel 48 is open on the front of the plate 44. Each channel 48 is configured to receive one of the ribs 40 of the securing element 34. In particular, each rib 40 of the securing element 34 extends into a corresponding one of the channels 48 defined by the ribs 46 of the adjustment element 32 when the fastener 26 secures the attachment portion 30 to the inner wall member 14. The engagement between or nesting of the ribs 40 of the securing element 34 and the ribs 46 of the adjustment element 32 inhibits rotation of the adjustment element and securing element relative to one another.

The attachment element 30 includes at least one frangible link 50 interconnecting the adjustment element 32 and the securing element 34. In the illustrated embodiment, the attachment portion includes two frangible links 50, although more or fewer frangible links are within the scope of the present disclosure. Each frangible link 50 is configured to be broken to allow the adjustment element 32 to move relative to the securing element 34. In the illustrated embodiment, the frangible links 50 are thinned and/or weakened pieces of material that can be manually broken by applying enough force to the adjustment element 32, as explained in more detail below. Initially having the adjustment and securing elements 32, 34 attached together allows for easier installation by reducing the number of parts that are required to be held and/or aligned by an operator in order to secure the veneer tie 10 to the inner wall member 14. Moreover, by connecting the adjustment and securing elements 32, 34, the securing element is not a loose part that could easily be lost prior to the installation of the veneer tie 10. Other configurations and constructions of the attachment portion 30 are within the scope of the present disclosure. For example, in one embodiment, the adjustment element 32 and securing element 34 may not be connected together but separate components.

Still referring to FIGS. 2-5, the insertion portion 52 of the veneer tie 10 is secured to the attachment portion 30. The insertion portion 52 is configured for disposition in a bed joint 22 of the outer wall member 12, as shown in FIGS. 1 and 8-10. In the illustrated embodiment, the insertion portion 52 is fixed to the adjustment element 32. The insertion portion 52 extends in a direction that is generally transverse to the adjustment element 32. Thus, the veneer tie 10 has a generally L-shape. In the illustrated embodiment, the insertion portion 52 is corrugated. The corrugation of the insertion portion 52 forms a stronger connection with the mortar in the bed joint 22 (than a flat piece of material) to strengthen the anchoring of the veneer tie 10 in the outer wall member 12 to resist forces due to wind and seismic activity. The insertion portion 52 includes a plate 54. The insertion portion 52 also includes a rib 56 extending longitudinally along the insertion portion. In the illustrated embodiment, the rib 56 extends along the entire length L of the insertion portion 52. The rib 56 projects downward from the plate 54. The rib 56 strengthens and stiffens the insertion portion 52. The insertion portion 52 may also include one or more mortar holes 58 configured to receive mortar when the insertion portion is embedded in the bed joint 22 to further increase the strength of the connection between the insertion portion and the outer wall member 12.

The insertion portion 52 includes two ribs 60 (broadly, at least one rib) extending from the end of the insertion portion attached to the attachment portion 30. Each rib 60 is aligned and continuous with one of the ribs 46 of the adjustment element 32 of the attachment portion 30. In other words, the aligned ribs 46 and 60 form a single rib that wraps around the connection (e.g., bend) between the attachment portion 30 and the insertion portion 52 to strengthen and stiffen the connection between the attachment and insertion portions.

When the veneer tie 10 is attached to the inner wall member 14, the insertion portion 52 extends across the cavity 20 to the bed joint 22 in the outer wall member 12. As shown in FIG. 1, the attachment portion 30 lies generally flat against the inner wall member 14, while the insertion portion 52 extends generally horizontally to the outer wall member 12. The insertion portion 52 may have different lengths L to accommodate walls of various constructions and/or cavity 20 sizes. For example, the insertion portion may have a length of 6 inches (15 cm), 5 inches (13 cm), or 4 inches (10 cm). Other dimensions are within the scope of the present disclosure. When the insertion portion 52 is inserted into the outer wall member 12, the insertion portion is in a substantially horizontal plane with the bed joint 22. The insertion portion 52 extends from the attachment portion 30 across the cavity 20 and into the bed joint 22. A section (e.g., distal portion) of the insertion portion 52 is surrounded by the mortar and secured within the bed joint 22. Mortar is received through the holes 58. The corrugation of the insertion portion 52 and the mortar passing through the holes 58 resists the veneer tie from being pulled out of the bed joint 22.

Figure 6:
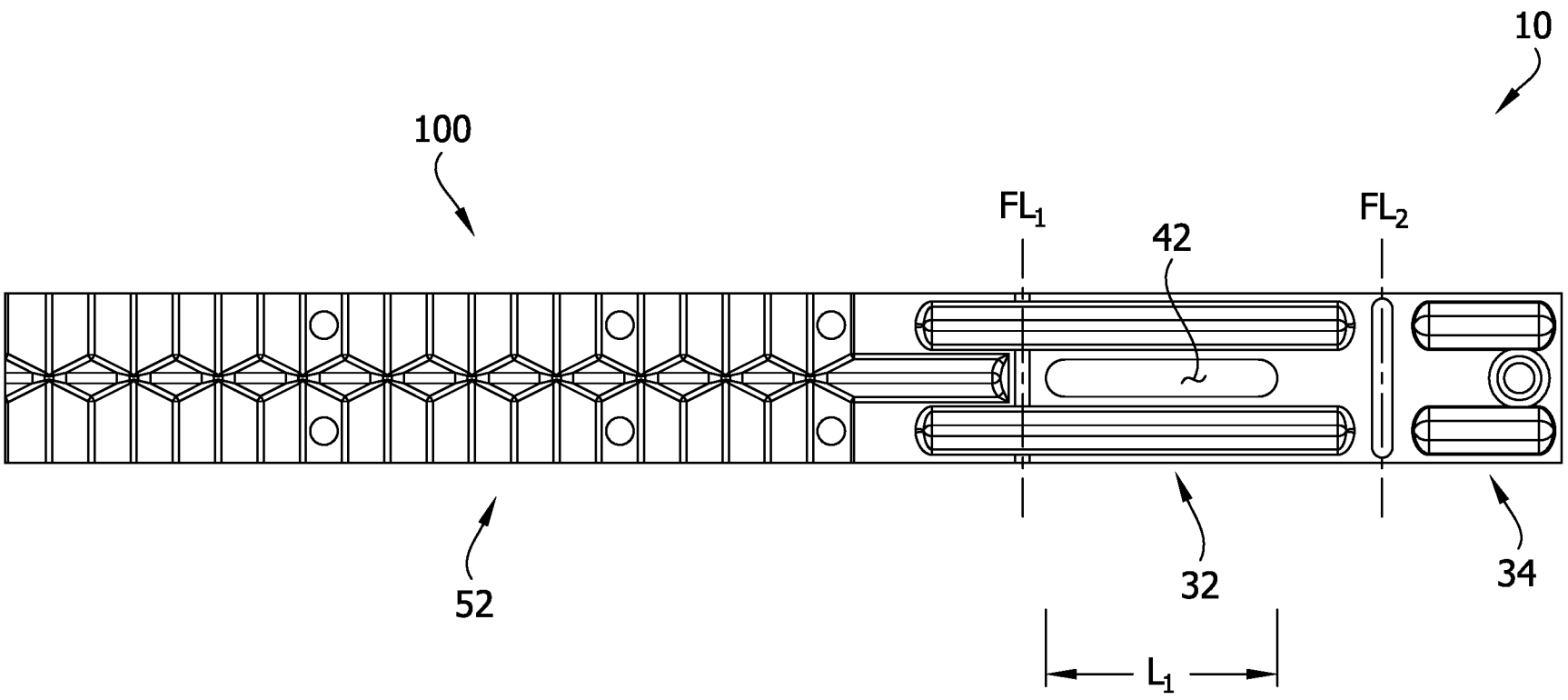
FIG. 6 is a top view of the veneer tie in an unbent configuration
Figure 7:
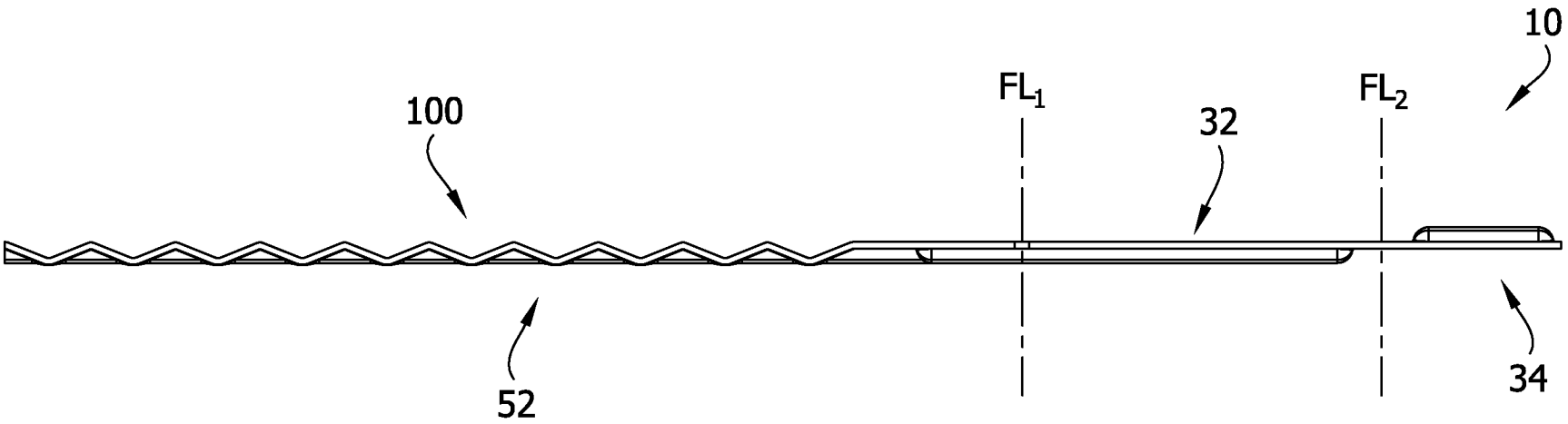
FIG. 7 is a side view thereof.

Referring to FIGS. 6 and 7, the veneer tie 10 can be formed from a unitary piece of material. The veneer tie 10 can be made from a single piece of metal, such as steel or aluminum, or other suitable material (e.g., the insertion and attachment portions 52, 30 are one piece). For example, the veneer tie 10 can be stamped from a piece of sheet metal and bent into shape. FIGS. 6 and 7 illustrated a cut metal blank 100 that has been partially stamped to form the various components of the veneer tie, such as but not limited to the ribs 46, 56, 60, openings 36, 42, 58, etc. To finish forming the veneer tie 10 from the cut metal blank 100, the cut metal blank 100 is bent approximately 90 degrees along a fold line $FL_1$ and the approximately 165-180 degrees along another fold line $FL_2$. For example, in the illustrated embodiment the cut metal blank is bent approximately 175 degrees along fold line $FL_2$ to form the veneer tie 10 such that the securing element 34 is at an angle to the adjustment element 32. The fold lines $FL_1$ and $FL_2$ generally separate the portions of the cut metal blank 100 that form the adjustment, securing and insertion portions 32, 34, 52 of the veneer tie 10. The portions of the cut metal blank 100 forming the frangible links 50 generally extend across the fold line $FL_2$. Accordingly, bending the cut metal blank 100 along fold line $FL_2$ weakens the material (e.g., metal) forming the frangible links 50. In other words, the frangible links 50 are bendable links interconnecting the adjustment element 32 and the securing element 34. In one embodiment, the veneer tie is stamped from 16 gauge steel, although other thicknesses (e.g., 12-18 gauge) and other suitable materials are within the scope of the present disclosure. In one embodiment (not shown), the veneer tie 10 is made from separate pieces that are joined together, such as by welding.

Figure 9:
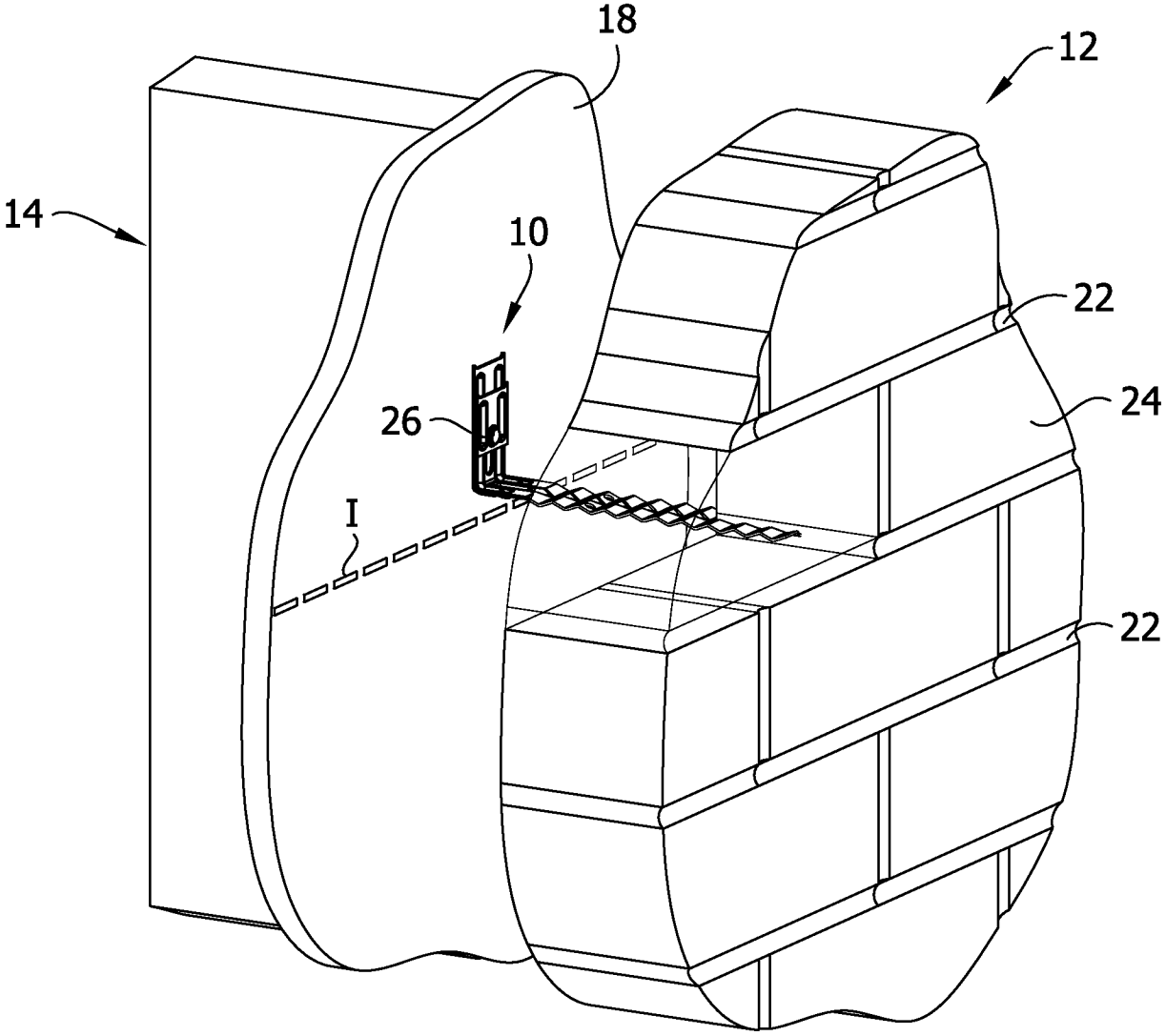
FIG. 9 is similar to FIG. 8, except the bed joints in the outer wall member are at a different position relative to the inner wall member and the insertion portion of the veneer tie is disposed at a second position relative to the inner wall member to compensate for the different position of the bed joints.
Figure 10:
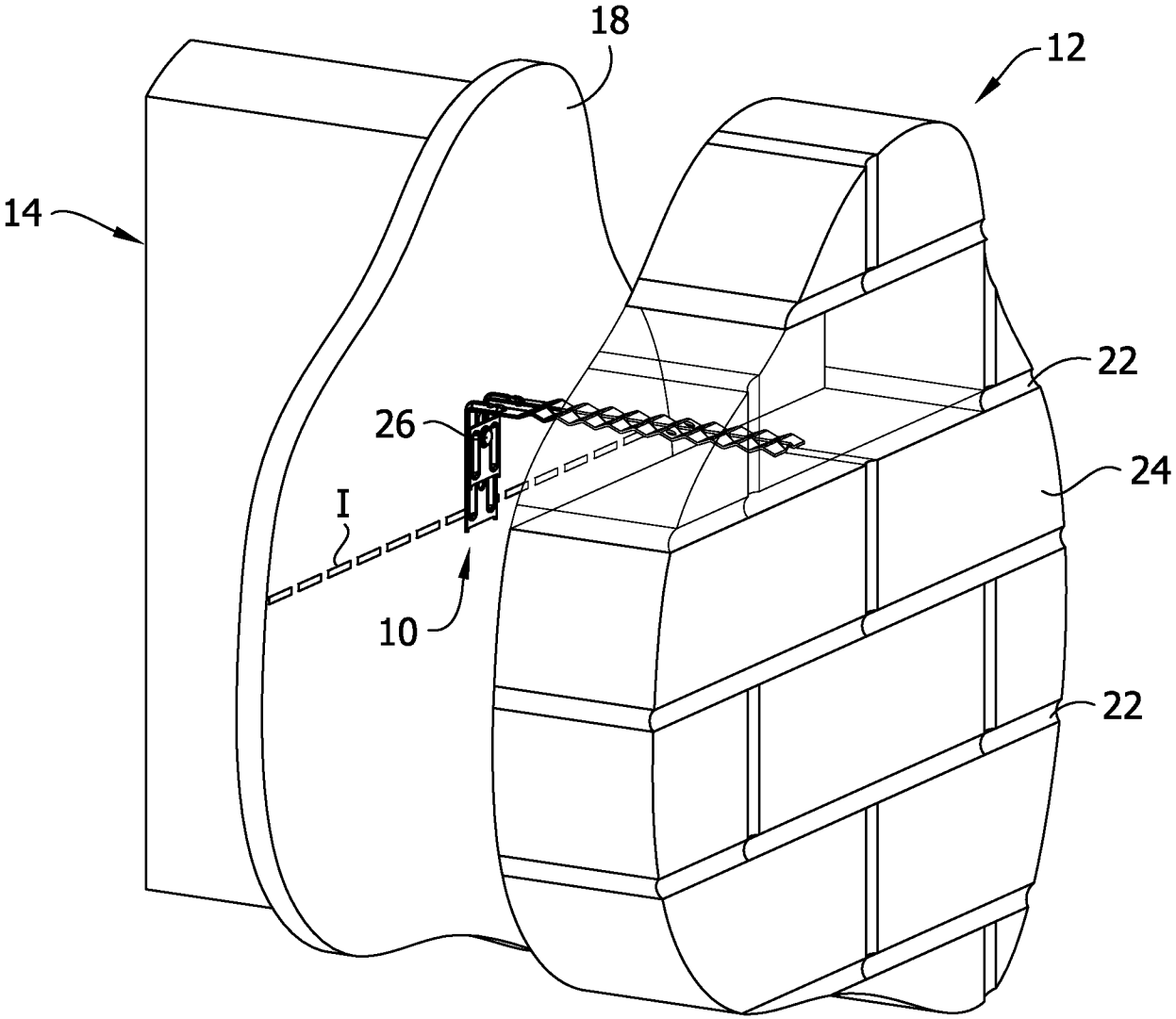
FIG. 10 is similar to FIGS. 8 and 9, except the bed joints in the outer wall member are at a different position relative to the inner wall member and the insertion portion of the veneer tie is disposed at a third position relative to the inner wall member to compensate for the different position of the bed joints.

Referring to FIGS. 8-10, to mount or secure the veneer tie 10 to the inner wall member 14, a fastener 26 is inserted through the attachment portion 30 and driven into the inner wall member. When mounted, the attachment portion 30 is generally parallel to the exterior surface 18 of the inner wall member 14 and the insertion portion 52 is generally perpendicular to the exterior surface. The fastener 26 compresses the attachment portion 30 against the inner wall member 14, securing the veneer tie 10 to the inner wall member. Specifically, the fastener 26 compresses the securing element 34 against the adjustment element 32. As a result, the ribs 46 of the adjustment element 32 engage the exterior surface 18 of the inner wall member. The ribs 46 outwardly offset the plate 44 of the adjustment element 32 to prevent the edges (e.g., peripheral edges) of the plate from tearing a moisture barrier (not shown), such as asphalt paper, that typically forms the exterior surface 18 of the inner wall member 14, as the adjustment element is moved, as described in more detail below. Preferably, the ribs 46 are rounded to allow the ribs to slide over the exterior surface 18, without tearing the moisture barrier. In addition, the fastener 26 pushes the securing element 34 against the adjustment element 32 such that the ribs 40 are positioned in the channels 48 of the adjustment element. This inhibits the adjustment and securing elements 32, 34 from rotating relative to one another, once the frangible links 50 are broken. Moreover, the fastener 26 pushing the securing element 34 against the adjustment element 32 further bends the frangible links 50, further weakening the links. The layered adjustment and securing elements 32, 34 increases the stiffness of the attachment portion 30 (over say an attachment portion with a single layer of material), which results in less deflection when loads are applied to the veneer tie 10.

The position of the insertion portion 52 of the veneer tie 10 relative to the inner and outer wall members 14, 12 is adjustable in order to position the insertion portion 52 within the bed joint 22 of the outer wall member 12. This allows the veneer tie 10 to compensate for differences between the actual and expected position of the bed joints 22 after the veneer tie 10 is mounted on the inner wall member 14. Some of the bricks in the outer wall member 12 are shown transparent in FIGS. 8-10 so that the insertion portion 52 may be seen. Generally, veneer ties, such as the veneer tie 10 of the present disclosure, are attached to the inner wall member 14 prior to the construction of the outer wall member 12. This allows building inspectors to inspect the veneer ties 10 to ensure building code compliance before the veneer ties are hidden from view by the outer wall member 12. In one example of construction, indicator lines I are drawn on the inner wall member 14 to mark the expected or predicted position of the bed joint 22 between the courses of bricks 24. The veneer tie 10 is then positioned on the inner wall member 14 such that the insertion portion 52 is aligned (e.g., horizontally aligned) with the indicator line I (FIG. 8). As the outer wall member 12 is built, if the bed joint 22 lines up with the indicator line I and, therefore, the insertion portion 52, no adjustment of the insertion portion is needed in order to embed the insertion portion in the bed joint (FIG. 8). However, if the bed joint 22 does not line up with the indicator line I, as shown in FIGS. 9 and 10, adjustment of the position (e.g., vertical position) of the insertion portion 52 is required in order to position (e.g., align, embed) the insertion portion in the bed joint.

When the veneer tie 10 is secured to the inner wall member 14, the securing element 34 is generally fixed in position on the inner wall member. In order to adjust the position of the insertion portion 52, the insertion portion is configured to move relative to the securing element 34 to move the insertion portion between and/or within an upper limit and a lower limit. The upper limit is the highest point the insertion portion 52 can be moved to relative to the securing element 34 (e.g., the fastener 26) and lower limit is the lowest point the insertion portion can be moved to relative to the securing element. Preferably, the distance between the upper and lower limit is equal to or greater than one half the height of a course of bricks 24 to ensure that the insertion portion 52 can be moved into a position where the insertion portion can be embedded into one of the bed joints 22 of the outer wall member 12. In order to move the insertion portion 52 between the upper and lower limits, the adjustment element 32 is configured to linearly move relative to the securing element 34 and/or rotate relative to the fastener 26.

To move the insertion portion 52 to position the insertion portion in a bed joint 22, first the frangible links 50 must be broken in order to allow the adjustment element 32 to move relative to the securing element 34. To break the frangible links 50, an operator (e.g., construction worker) applies a force to the insertion portion 52, such as by tapping or hitting the insertion portion with a hammer (not shown). For example, in the orientation shown in FIG. 8, hitting the insertion portion 52 with an upward force from the hammer will break the frangible links 50. From the orientation shown in FIG. 8, once the frangible links 50 are broken, the adjustment and insertion portions 32, 52 can be moved (e.g., slid) upward relative to the securing element 34, as shown in FIG. 9. Further taps with the hammer against the insertion portion 52 can be made to move the insertion portion. When the adjustment element 32 is moved (e.g., vertically moved) relative to the securing element 34, the fastener 26 moves within the slot 42 and the ribs 40 of the securing element move within the channels 48 of the adjustment element. The engagement of the fastener 26 with the ends of the slot 42 limit the amount of movement. In the illustrated embodiment, the opening 36 in the securing element 32 is generally aligned with one end of the slot 42 such that the adjustment element 32 can only move in one direction relative to the securing element immediately after the frangible links 50 are broken, although other arrangements are within the scope of the present disclosure. Of course, once the adjustment element 32 is moved relative to the securing element 34, the adjustment element may be moved vertically up or down (e.g., first and second directions) relative to the securing element.

The length $L_1$ (FIG. 6) of the slot 42 determines the amount of movement of the adjustment and insertion portions 32, 52 relative to the securing element 34. Preferably, the length $L_1$ of the slot 42 is equal to or greater than half the height of a course of bricks 24, to ensure the insertion portion 52 can be positioned within one of the bed joints 22 of the outer wall member 12. In order to move the insertion portion 52 to any position over the entire height of the course of bricks 24 (e.g., between the upper and lower limits), the attachment portion 30 is configured to rotate relative to the inner wall member 14. In particular, the attachment portion 30 is able to rotate about the fastener 26. For example, in one embodiment, the insertion portion 52 may need to be positioned in a bed joint 22 disposed above the fastener 26 (FIG. 10). In order to accommodate this scenario, the attachment portion 30 is configured to rotate between a first position and a second position. In the first position, the insertion portion 52 is below the fastener 26 (FIG. 8) and in the second position, the insertion portion is above the fastener (FIG. 10). In the second position, the veneer tie 10 (e.g., attachment portion 30) is generally inverted relative to the first position. In other words, an operator rotates the veneer tie 10 approximately 180 degrees about the fastener 26 to move the attachment portion 30 between the first and second positions. Being able to rotate the veneer tie 10 allows the slot 42 to have a shorter length $L_1$ (e.g., a length less than the height of the bricks 24), reducing the amount of material used to construct the veneer tie, while allowing the insertion portion 52 to be able to be moved to any position over the height of the bricks. When the attachment portion 30 is rotated, the adjustment element 32 and securing element 34 rotate together. Once inverted (FIG. 10), the attachment portion can be moved downward relative to the securing element 34, to move the insertion portion 52 downward and into the bed joint 22. When the adjustment element is moved, either vertically or rotated, the ribs 46 of the adjustment element 32 slide over the exterior surface 18 of the inner wall member 14.

Having described the disclosure in detail, it will be apparent that modifications and variations are possible without departing from the scope of the disclosure defined in the appended claims. For example, where specific dimensions are given, it is understood these dimensions are illustrative and other dimensions are within the scope of the present disclosure.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products without departing from the scope of the disclosure, it is intended that all matter contained in the above description and shown in the accompanying drawings shall be interpreted as illustrative and not in a limiting sense.

What is claimed is:

1. A veneer tie for use in a wall to join an inner wall member and an outer wall member of the wall, the outer wall member formed from a plurality of successive courses of masonry units with a mortar-filled bed joint between each two adjacent courses, the veneer tie comprising:

an insertion portion configured for disposition in the bed joint; and an attachment portion including an adjustment element, a securing element, and at least one frangible link interconnecting the adjustment element and the securing element, the securing element defining a first opening configured to receive a fastener to secure the attachment portion to the inner wall member, the at least one frangible link configured to be broken to enable the adjustment element to move relative to the securing element in order to move the insertion portion relative to the outer wall member to position the insertion portion in the bed joint.

2. The veneer tie of claim 1, wherein the adjustment element is configured to move relative to the securing element to move the insertion portion between an upper limit and a lower limit.

3. The veneer tie of claim 2, wherein the securing element and adjustment element are inhibited from rotating relative to one another.

4. The veneer tie of claim 1, wherein the adjustment element is configured to linearly move relative to the securing element.

5. The veneer tie of claim 4, wherein the attachment portion is configured to rotate relative to the inner wall member.

6. The veneer tie of claim 5, wherein the attachment portion is configured to rotate between a first position and a second position.

7. The veneer tie of claim 6, wherein in the second position the attachment portion is inverted relative to the first position.

8. The veneer tie of claim 1, wherein the adjustment element is configured to be disposed between the inner wall member and the securing element.

9. The veneer tie of claim 8, wherein the adjustment element is configured to be compressed against the inner wall member by the securing element when the fastener secures the attachment portion to the inner wall member.

10. The veneer tie of claim 9, wherein the adjustment element defines a second opening aligned with the first opening and configured to receive the fastener when the fastener secures the attachment portion to the inner wall member.

11. The veneer tie of claim 10, wherein the second opening is an elongate slot, the elongate slot sized and shaped to permit the fastener to move within the slot.

12. The veneer tie of claim 1, wherein the at least one frangible link comprises a thin, bent strip interconnecting the adjustment element and the securing element.

13. The veneer tie of claim 1, wherein the insertion portion includes a first rib and the securing element includes a second rib, the first and second ribs being aligned and continuous with one another.

14. The veneer tie of claim 1, wherein the insertion portion extends in a direction that is generally transverse to the adjustment element.

15. The veneer tie of claim 1, wherein the insertion portion is corrugated.

16. The veneer tie of claim 1, wherein the adjustment element includes an inner face adapted to face the inner wall member upon mounting the veneer tie on the inner wall member and an outer face adapted to face outward away from the inner wall member upon mounting the veneer tie on the inner wall member, wherein the adjustment element includes a rib that projects inward from the inner face and toward the inner wall member to engage the inner wall member upon mounting the veneer tie on the inner wall member, the rib configured to space peripheral edge margins of the adjustment element from the inner wall member upon mounting the veneer tie on the inner wall member to prevent the peripheral edge margins from deforming the inner wall member when the adjustment element is moved relative to the securing element.

17. The veneer tie of claim 1, wherein the securing element, the insertion portion and attachment portion are formed as a unitary, one piece component.

18. A method of positioning a veneer tie on a wall, the wall having an inner wall member and an outer wall member, the outer wall member formed from a plurality of successive courses of masonry units with a mortar-filled bed joint between each two adjacent courses, the method comprising:

securing an attachment portion of the veneer tie to the inner wall member, the attachment portion including an adjustment element, and a securing element, and at least one frangible link interconnecting the adjustment element and the securing element;

breaking said at least one frangible link to disconnect the adjustment element from the securing element; and moving the adjustment element relative to the securing element to position an insertion portion of the veneer tie in the bed joint.

19. The method of claim 18, wherein breaking said at least one frangible link comprises manually hitting the insertion portion with a hammer.

20. A veneer tie for use in a wall to join an inner wall member and an outer wall member of the wall, the outer wall member formed from a plurality of successive courses of masonry units with a mortar-filled bed joint between each two adjacent courses, the veneer tie comprising:

an insertion portion configured for disposition in the bed joint; and an adjustment element connected to the insertion portion and having a slot configured to receive a fastener and a rib defining a channel;

a securing element engageable with the attachment portion and defining a first opening configured to receive the fastener to secure the securing element and adjustment element to the inner wall member, the securing element including a rib configured to nest in the channel defined by the rib of the attachment portion to inhibit rotation of the adjustment element relative to the securing element;

wherein the adjustment element is movable relative to the securing element prior to the adjustment element and securing element being secured to the inner wall by the fastener in order to move the insertion portion relative to the outer wall member to position the insertion portion in the bed joint.

* * * * *